US005547252A

United States Patent [19]

Pfenniger

[11] Patent Number: 5,547,252

[45] Date of Patent: Aug. 20, 1996

[54] OFFICE CHAIR

[75] Inventor: Reto Pfenniger, Ammannsegg, Switzerland

[73] Assignee: Girsberger Holding AG, Bützberg, Switzerland

[21] Appl. No.: 289,465

[22] Filed: Aug. 12, 1994

[30] Foreign Application Priority Data

Aug. 14, 1993 [DE] Germany ..... 43 27 373.4

[51] Int. Cl.[6] ..... A47C 3/00

[52] U.S. Cl. ..... 297/300.3; 297/344.19

[58] Field of Search ..... 297/344.12, 344.16, 297/344.18, 344.19, 300.1, 300.2, 309, 285, 300.3, 300.4

[56] References Cited

U.S. PATENT DOCUMENTS

| | | | |
|---|---|---|---|
| 3,830,491 | 8/1974 | Christians | 297/285 X |
| 4,685,733 | 8/1987 | Machate et al. | 297/300.4 X |
| 4,707,028 | 11/1987 | Gamberini | 297/285 X |
| 4,979,778 | 12/1990 | Shields | 297/301 |

FOREIGN PATENT DOCUMENTS

| | | |
|---|---|---|
| 8614185 | 8/1986 | Germany . |
| 4235691 | 6/1993 | Germany . |

*Primary Examiner*—Milton Nelson, Jr.
*Attorney, Agent, or Firm*—Panitch Schwarze Jacobs & Nadel, P.C.

[57] ABSTRACT

A chair (1), in particular a swiveling office chair, has a seat support (6) fastened to a lower part (7) joined in a swiveling fashion with a seat (2) that is motionally coupled with a backrest (3) by a synchronizing sliding guide (5) or by a similar synchronizing mechanism, whereby the seat (2) is supported by a readjusting apparatus (8) that acts against swinging movement. The chair (1) is characterized by the seat support (6) being guided at the lower part (7) in an approximately vertical direction, and by having within the movement transmission path between the backrest (3) and the lower part (7) of the chair, an apparatus (14) for blocking of and/or compensating for movement transmitted to the readjusting apparatus (8) during a backward swiveling movement of the backrest (3). The readjusting force of the backrest (3) is automatically adapted depending on the weight of the person using the chair, and increases with increasing inclination of the backrest. The chair is distinguished by its simple construction and compact design.

16 Claims, 4 Drawing Sheets

OFFICE CHAIR

FIELD OF THE INVENTION

The invention relates to an office chair with a seat support that is fastened to a lower part of the chair and that is joined in a swiveling fashion with a seat that is movably coupled with a backrest by means of a synchronizing sliding guide or by a similar synchronizing mechanism, whereby the seat is supported by a readjusting apparatus that acts in opposition to swinging movement.

BACKGROUND OF THE INVENTION

In order to offer the person sitting in a chair good seating comfort, in the case of high-quality office chairs, it is known that the seat and the backrest (seatback) can be movably coupled with one another via a synchronizing mechanism in such a way that an adjustment of the backrest also has as a consequence a simultaneous and dependent adjustment of the seating surface. As a result of this synchronized adjustment of the seat and the backrest, the chair is adapted to the ergonometry of the person using the chair.

During adjustment of the backrest of such office chairs, the leaning force of the person using the chair is opposed to the readjusting force of a readjusting apparatus that simultaneously supports the seat, which is joined with a seat support in a swiveling fashion, in opposition to a swinging movement. In this regard, the readjusting force acting against the leaning force of the person using the chair must be greater in the case of large and heavy persons, due to the greater body weight, and must increase even more with increasing backward inclination of the backrest and in accordance with a lengthened lever arm, whereby, however, this increase in force should still remain dependent on the weight of the person using the chair.

In order not to burden the person using the chair with the adaptation of the adjusting apparatus to his body weight, and in order to eliminate resulting erroneous adjustments, various office chairs have already been created in which the adaptation of the readjusting force to the leaning force of the person using the chair is carried out automatically depending upon the person's body weight.

From German utility model DE-GM 86 14 185.6 an office chair is known, whose seat is joined by means of a front and a rear parallelogram link rod to a fixed seat support that is attached to a lower part of the seat. The seat of this previously known office chair is movably coupled with the backrest by means of a synchronizing mechanism comprising additional swiveling link arms in such a way that during an adjustment of the backrest, the seat is lowered from its normal position to a greater extent in the rear than in the front, and carries out a movement towards the rear following the backrest. As this is taking place, the seat is supported by means of a readjusting apparatus that acts in opposition to the swinging movement and that consists of two readjusting springs that are more or less strongly prestressed, depending upon the weight of the person using the chair. By means of the readjusting apparatus and its readjusting springs, it is possible to achieve a movement of the backrest, together with the synchronized movement of the seat that is coupled with it, that takes place more or less with little effort.

This previously known office chair has a relatively complex mechanical design characterized by a large number of linking points and movable link arms in order to coordinate the sequence of movements between the seat and the backrest. As a result, there exists the problem of creating, in particular, an office chair of the type mentioned at the outset, in which the readjusting force of the backrest is automatically adapted to the weight of the person using the chair, and which increases with increasing inclination of the backrest, but is distinguished by a simple mechanical design.

SUMMARY OF THE INVENTION

In the case of the chair of the type mentioned at the outset, the solution of this problem is achieved in accordance with the invention specifically by having the seat support movably guided at the lower part of the chair in an approximately vertical direction, by supporting the seat at the lower part of the chair by means of the readjustment apparatus, and by providing within the movement transmission path between the backrest and the lower part of the chair an apparatus for blocking and/or compensating for the movement transmitted to the readjusting apparatus during a backward swiveling movement of the backrest.

In the case of the office chair in accordance with the invention, the seat is supported on the lower part of the chair by means of the readjusting apparatus. The seat support is joined in a swiveling fashion with the seat and is movably guided in the vertical direction at this lower part of the chair. If the seat is loaded by the body weight of a person using the chair, the readjusting apparatus provided for readjusting the seat is prestressed. This prestressing of the readjusting apparatus does not, however, have an effect on the inclination of the backrest that is motionally coupled with the seat because specifically, the seat support can deflect slightly in a downward direction at a lower part of the chair in accordance with the body weight of the person using the chair. The seat and backrest are movably coupled with one another by means of a synchronizing sliding guide or similar synchronizing mechanism.

When there is a decrease in leaning force of a person using the chair upon the backrest, the synchronized readjusting movement of the backrest and seat is assured by the readjusting apparatus in the same way. Since the readjusting apparatus is simultaneously prestressed by the weight of the person using the chair, the readjusting force of the backrest, which acts as a load moment in opposition to the leaning force, is automatically adapted to the weight of the person using the chair, and increases with the increasing inclination of the backrest. In principle, the readjusting apparatus of the office chair in accordance with the invention can thus function with only one readjusting spring or similar readjusting force, even though several such readjusting springs can of course be provided.

During an adjustment of the backrest, the leaning force applied as a result of leaning back enters the movement transmission path of the chair in accordance with the invention. As a result of this leaning force, the readjusting apparatus acting in opposition to it is additionally prestressed beyond the weight of the user. In order to prevent a springing back of the seat during an adjustment of the backrest, and in order to avoid a resulting loss of the weight-dependent prestressing of the readjusting apparatus, there is provided within the movement transmission path between the backrest and the lower part of the chair an apparatus for blocking and/or compensating for the movement transmitted to the readjusting apparatus during a backward swiveling movement of the backrest.

It is helpful if the blocking apparatus is active in the transmission of movement between the seat support and the lower part of the chair, and if the blocking apparatus is activated during a backward swiveling movement of the backrest. As a result of the blocking apparatus acting between the seat support and the lower part of the chair, a lifting of the seat during an adjustment of the backrest is counteracted. The blocking apparatus is actuated even during a comparatively slight leaning force acting upon the readjusting apparatus if the blocking apparatus can be activated by a backward swiveling movement of the backrest. In this conjunction, it is particularly advantageous if the blocking apparatus is coupled with the synchronizing sliding guide or similar synchronizing mechanism.

In accordance with a further development according to the invention, the blocking apparatus is configured as a braking device, preferably engaged frictionally, that is rigidly joined to the seat support and that, in its blocking position, engages with the lower part of the chair. A braking device that engages frictionally can be activated with practically infinite variability and unnoticed by the person using the chair, when the backrest is returned to its original position.

In a preferred embodiment of the invention, a form that improves the relatively simple design of the inventive chair even further, the blocking apparatus is a clamping collar or clamping strap that preferably encompasses a section of the lower part of the chair that extends in an approximately vertical direction. In its blocking position, the blocking apparatus lies at least partially in frictional engagement against this section of the lower part of the chair. So that the clamping collar or clamping strap does lie in frictional engagement against the lower part of the chair when the person using the chair leans back, it is advantageous if at least one of the two free collar arms of the collar clamp is provided on the outside with a ramp bevel, preferably helical in shape, that works in conjunction with a corresponding matching bevel supported in an essentially immovable manner in the axial direction and movably coupled with the backrest. As a result of a rotating movement of the matching bevel, which is supported in a rotatable fashion, this bevel slides on the ramp bevel so that these bevel surfaces move away from each other in an axial direction. Since the matching bevel is supported in the axial direction in an immovable fashion, only the ramp bevel can deflect in the direction toward the opposite collar arm of the collar clamp. As a result, the collar arms of the collar clamp are pressed toward each other, so that the collar strap lies in frictional engagement against the lower part of the chair.

In order to be able to actuate the clamping collar, other designs are also conceivable by which a pressing together of the collar arms can be achieved. For example, an internal thread could be placed on at least one of the collar arms that would work in conjunction with the external thread of a rotatably supported shaft. If such a shaft were rotated during an adjustment of the backrest, the collar arms of the clamping collar would also move towards or away from each other.

In order to be able to move the collar arms as evenly as possible relative to each other, and in order to hold the clamping collar as securely as possible at the lower part of the chair, it is advantageous that each of the two free collar arms of the clamping collar have a helical ramp bevel, that each of the two ramp bevels have allocated to it a matching bevel supported in an essentially immovable fashion in the axial direction, and that these beveled surfaces on the opposite sides of the clamping collar have a helical shape oriented in the opposite direction of rotation.

The simple design and advantageous construction of the office chair in accordance with the invention is improved even further if the adjusting apparatus uses for force adjustment a torsion bar that is located in the swiveling axis between the seat and the seat support, and if this torsion bar is held at the seat, on the one hand, in a fixed manner so it cannot rotate and is joined, on the other hand, to a support lever that is supported in the region of its free end at the lower part of the chair in a fixed manner so it cannot rotate. An embodiment of this type, in which the torsion bar is located in the swiveling axis between the seat and the seat support, allows an especially compact construction for the office chair and its readjusting apparatus.

In order to make possible a height adjustment of the chair in accordance with the invention on the one hand, and on the other, to ensure the spring deflection of the seat for the prestressing of the spring element of the readjusting apparatus, it is beneficial if the lower part of the chair is adjustable in height and if the lower part of the chair has for that purpose two vertical guides with, preferably, two enclosing guide bushings, of which the first guide bushing is associated with a gas pressure spring or similar height adjustment element, and the second guide bushing is associated with the seat support.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. The individual features can be realized either singly or multiply in an embodiment in accordance with the invention.

DETAILED DESCRIPTION OF PREFERRED EMBODIMENTS

Figure 1:
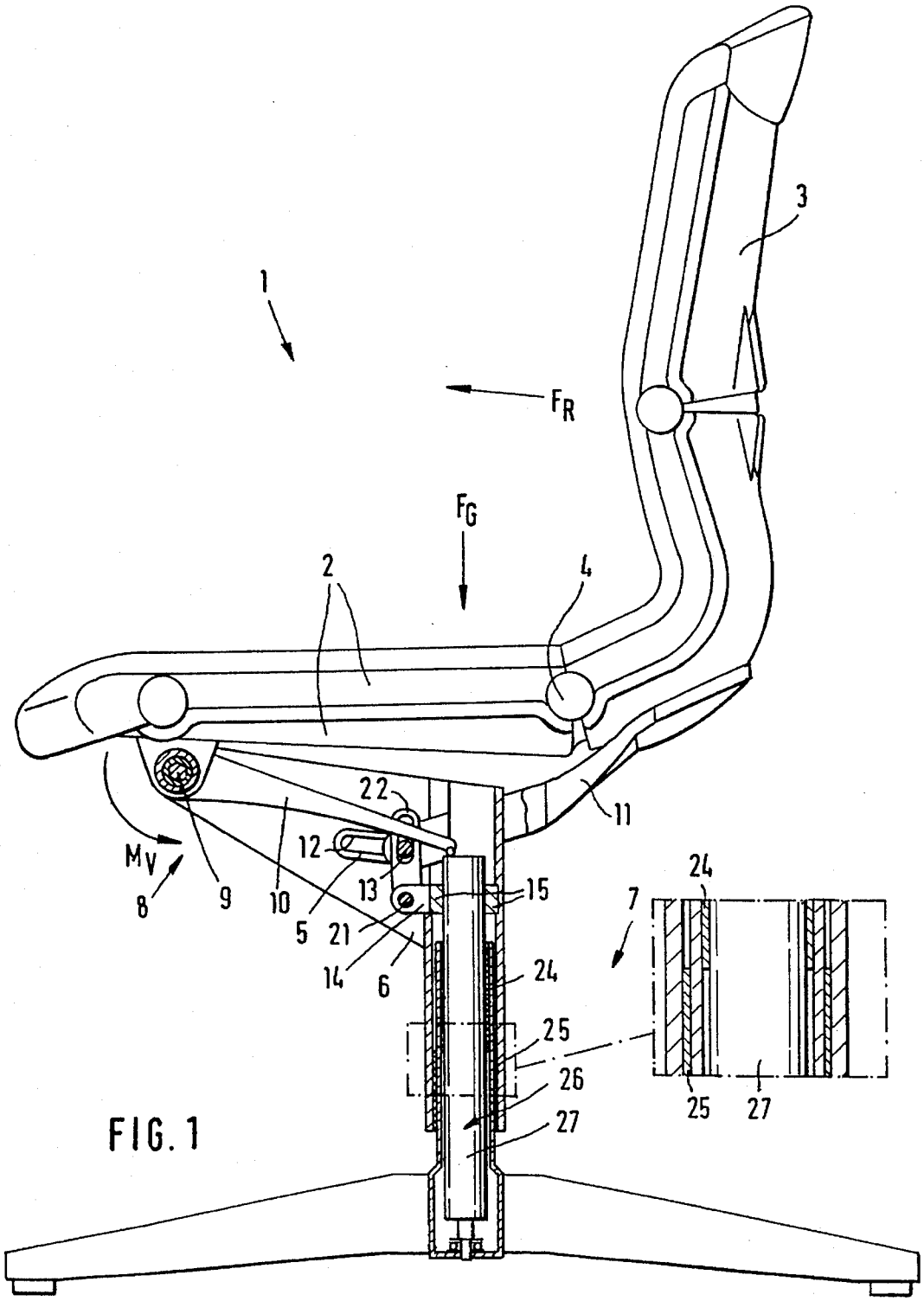
FIG. 1 is a side view of an office chair with a synchronizing adjustment mechanism, in which the readjusting force of the backrest is automatically adapted depending on the weight of the person using the chair and increases with increasing inclination of the backrest, wherein the office chair in the region of its substructure is shown cut away along its longitudinal center axis.

In FIG. 1, an office chair is shown, the seating surface of which is formed by a seat 2 and a backrest 3. The seat 2 and the backrest 3 that is joined with it by means of the joint 4 are movably coupled with one another by means of a synchronizing sliding guide 5 in such a way that an adjustment of the backrest 3 simultaneously results in an adjustment of the seat 2, which is dependent therefrom. The chair 1 is adapted to the ergonometry of the person using the seat by means of such a synchronized adjustment of the seat 2 and backrest 3.

In the front region of the underside of the seat, the seat 2 is joined in a swiveling fashion with a seat support 6, which is in turn guided in a movable fashion in a vertical direction at a lower part 7 of the chair. The seat 2 that is joined in a swiveling fashion with the seat support 6 is supported at the lower part 7 of the chair by means of readjusting apparatus 8 that acts in opposition to the swinging movement of the seat 2. For that purpose, the readjusting apparatus has for readjusting force a torsion bar 9, which is compactly placed in the swiveling axis between the seat 2 and the seat support 6, and which exerts on the seat a force that is directed in the direction of rotation $M_V$. The torsion bar 9, which is described in more detail further below, is held on the one hand at the seat 2, in a fixed manner so it cannot rotate, and is joined on the other hand, in a fixed manner so it cannot rotate, to a support lever 10 whose free end region contacts the lower part 7 of the chair.

If the seat 2 has placed upon it the body weight $F_G$ of a person using the chair, the readjusting apparatus 8 provided for readjustment of the seat 2 is prestressed. This prestressing of the readjusting apparatus 8 does not have an effect on the inclination of the backrest 3 that is movably coupled with the seat 2, specifically because the seat support 6 can deflect slightly in a downward direction at the lower part 7 of the chair in accordance with the body weight of the person using the chair. Since the readjusting apparatus 8 is prestressed by the weight of the person using the chair, the readjusting force $F_R$ of the backrest 3, which acts as a load moment in opposition to the leaning force, is also automatically adapted to the weight of the person using the chair, and increases with the increasing inclination of the backrest. When there is a decrease in the leaning force that is applied to the backrest 3 by a person using the chair, the synchronized readjusting movement of the backrest 3 and seat 2 by means of the synchronizing sliding guide 5 is ensured by the readjusting apparatus 8 in the same way. As a result, the readjusting apparatus 8 of the office chair 1 can therefore in principle function with one torsion bar or similar readjusting force.

As shown in FIG. 1, the backrest 3 is joined with a backrest support 11, which is displaceably guided in the synchronizing sliding guide 5 and is here configured as a lumbar support. For this purpose, the synchronizing sliding guide 5 has an oblong hole 12 on both respective sides of the seat support 6, which is approximately V-shaped in top view, whereby these oblong holes 12 are penetrated by an axle 13 that passes through and that is fixedly joined with the backrest support 11.

During an adjustment of the backrest, the leaning force applied as a result of leaning back enters the movement transmission path of the chair 1. As a result of this leaning force, the readjusting apparatus 8 acting in opposition to it is additionally prestressed beyond the weight of the user. The prestressing of the readjusting apparatus 8 is thus greater than corresponds to the weight of the user. In order to now prevent a springing back of the seat 2 as well as a lifting of the seat support 6 at the lower part 7 of the chair, and in order to avoid a loss of the weight-dependent prestressing in the readjusting apparatus 8, there is provided within the movement transmission path between the backrest 3 and lower part 7 of the chair an apparatus 14 for blocking the movement that is transmitted to the readjusting apparatus 8 during a backward swiveling movement of the backrest 3. The blocking apparatus 14 is coupled with the synchronizing sliding guide 5, and can be activated by a backward swiveling movement of the backrest 3.

Figure 3:
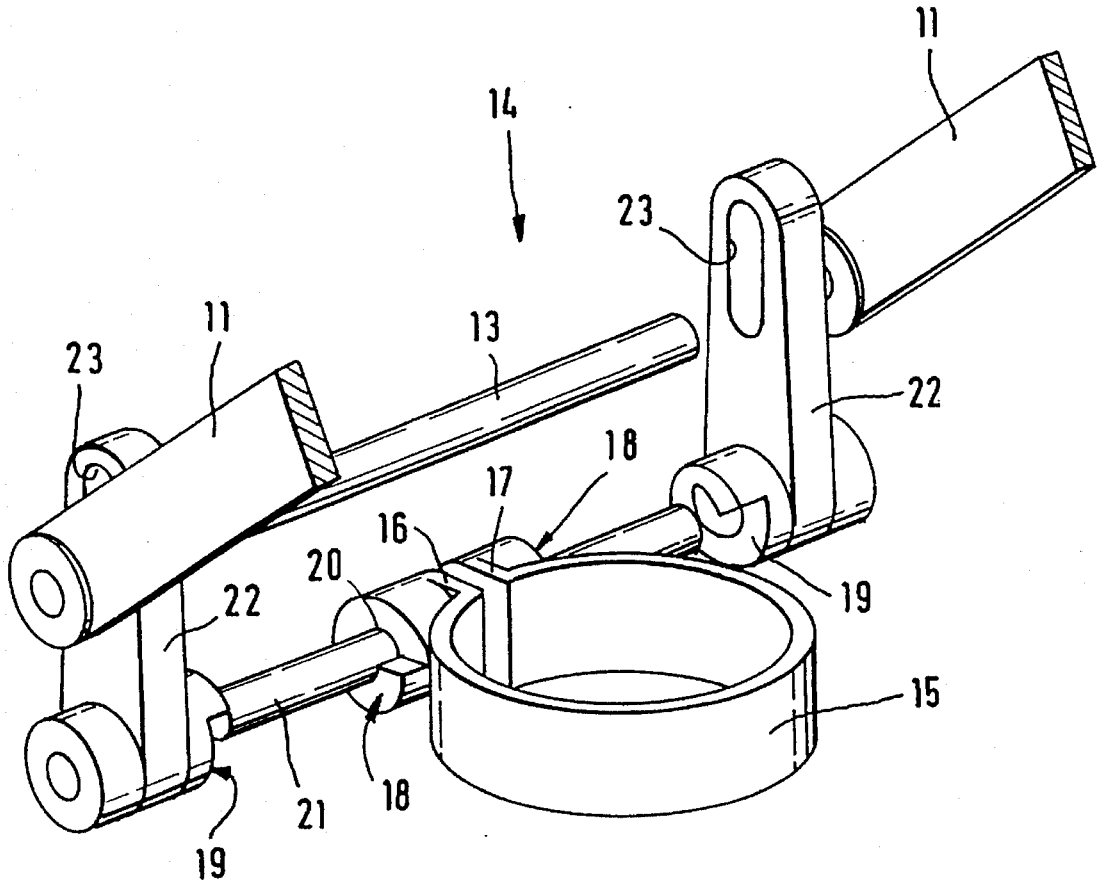
FIG. 3 is a schematic perspective view of a blocking apparatus of the office chair of FIGS. 1 and 2.

The design of the blocking apparatus 14 is made clear by FIG. 1 in combination with FIG. 3. The blocking apparatus 14 is configured as a braking device with frictional, and thus continuously variable engagement, that engages with the lower chair part 7 when in its blocking position. The blocking apparatus 14 has a clamping collar or clamping strap 15 with two collar arms 16, 17 that are offset towards the outside and are arranged approximately parallel to one another. The clamping collar 15 has on each of its two free collar arms 16, 17 a helical ramp bevel 18, whereby each of these helical ramp bevels 18 is paired with a matching bevel 19 that is seated in a manner which is essentially immovable in the axial direction. The beveled surfaces formed by the ramp bevels 18 and the matching bevels 19 are formed in a helical shape, in opposite directions of rotation, on opposing sides of the clamping collar 15.

Each of the ramp bevels 18 has a central opening 20 that is penetrated by an axle 21. Clamping levers 22 are provided at the two free end regions of the axle 21. The matching bevels 19, the clamping levers 22, and the axle 21 are joined with each other in a non-rotatable fashion. Each of the clamping levers 22 has on the end region opposite from the axle 21 an oblong hole 23, whereby these oblong holes 23 are penetrated by the axle 13 of the synchronizing sliding guide 5.

If the backrest 3 is adjusted towards the rear, the relative position of the seat 2 is also changed at the same time by means of the synchronizing sliding guide 5. Since the clamping levers 22 engage with the axle 13 of the synchronizing sliding guide 5, the blocking apparatus 14 is also activated by a backward swiveling movement of the backrest 3. As a result of the backward swiveling movement, by means of the backrest support 11, the axle 13 that is joined with it is moved forward as well, so that the clamping levers 22, which are supported so that they can rotate with the axle 21, swivel forward. As a result of this rotating or swiveling movement of the clamping levers 22, the matching bevels 19 that are joined with them in a non-rotating fashion slide on the ramp bevels 18. The corresponding helical configuration of these beveled surfaces and the essentially immovable seating of the matching bevels 19 in the axial direction cause the ramp bevels 18 and the collar arms 16, 17 of the clamping collar 15, which are joined with the ramp bevels as one piece, to move towards one another. As a result of this movement of the collar arms 16, 17, the circumference defined by the circular segment of the clamping collar 15 grows smaller, so that the clamping collar 15 comes to rest against the lower part 7 of the chair in a frictionally engaged manner.

The lower part 7 of the chair is designed so it is adjustable in height. FIG. 1 shows clearly that the lower part 7 of the chair has two vertical guides that overlap each other, with two guide bushings 24, 25 that enclose one another, of which a first guide bushing 24 is associated with a gas pressure spring 26 of a known type, and a second guide bushing 25 is joined with the seat support 6 in a fixed fashion. The clamping strap 15 is also immovably imbedded in this second guide bushing 25 in the vertical direction. The cylinder 27 of the gas pressure spring 26, which is supported in a rotatable fashion, projects above the first guide bushing 24 at the top. The clamping collar 15 engages with this projecting segment of the vertical gas pressure spring 26, while the support lever 10 is supported on the upper face of the cylinder 27.

Figure 2:
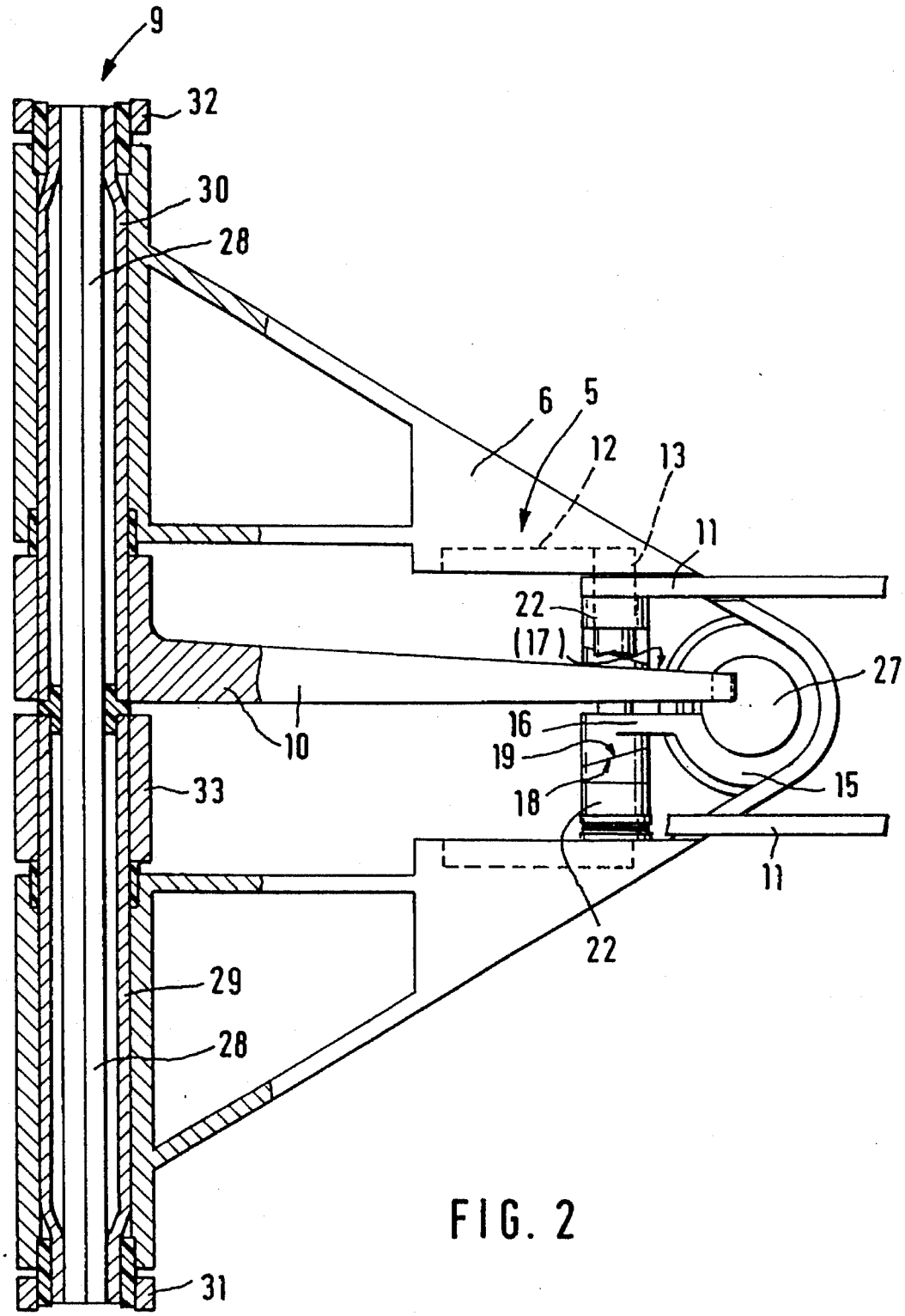
FIG. 2 is a partial cross-sectional view through the substructure of the office chair of FIG. 1.
Figure 4:
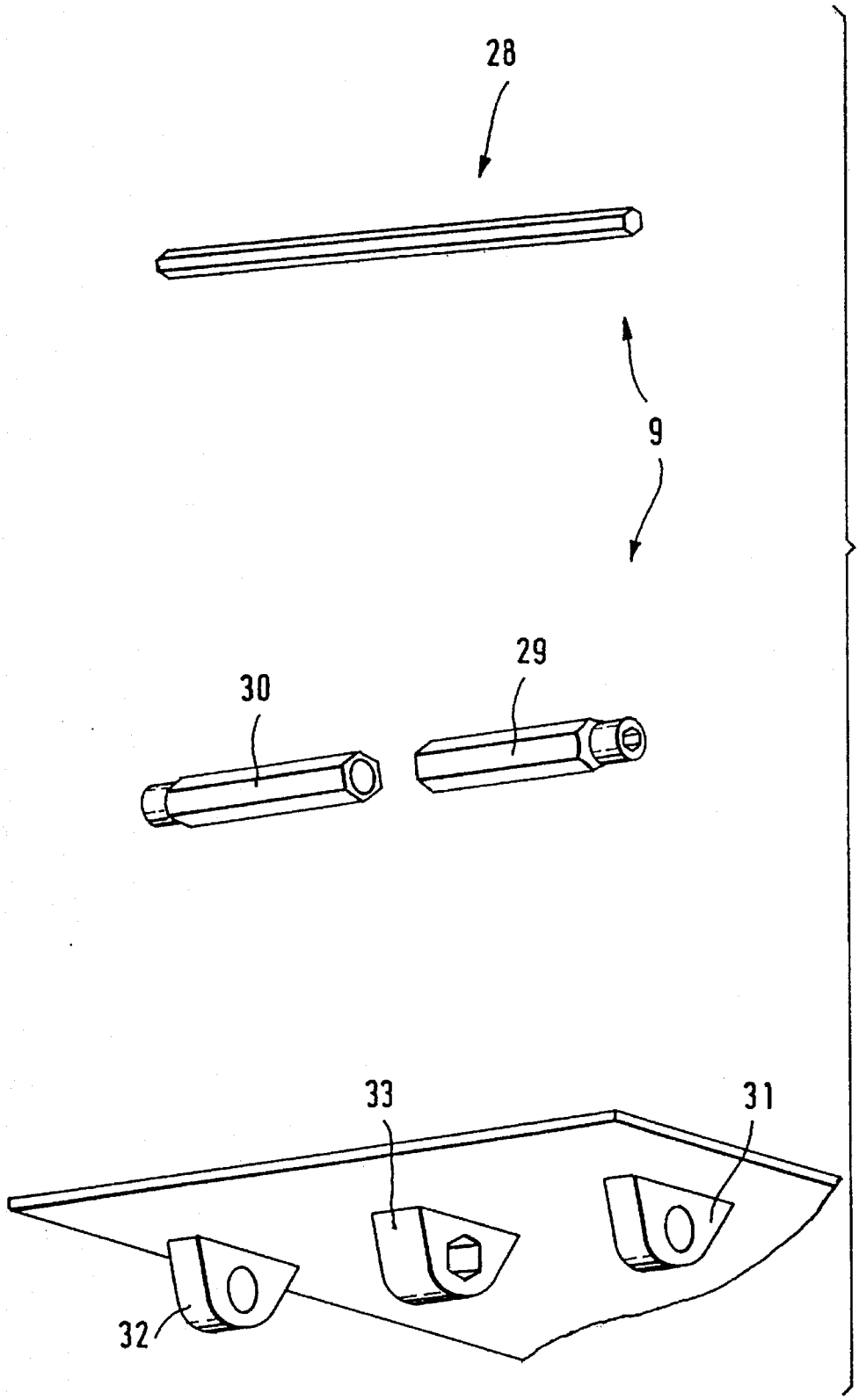
FIG. 4 is a schematic perspective view of the elements of a readjusting apparatus of the office chair of FIGS. 1 through 3 in the region of its torsion bar.

The design of the readjusting apparatus is made clear in FIGS. 2 and 4. As shown in FIG. 4, the torsion bar 9 includes a torque rod 28 with an angular cross-section, hexagonal in this case. Onto each of the two ends of the torque rod 28 there has been pressed a tubular bushing 29, 30 that also has an angular, that is hexagonal, external contour. Each of the tubular bushings 29, 30 has, towards the outside, end regions that are round in their external contour. The inner circumference of these outer end regions of the tubular bushings 29, 30 is matched in shape to the outer circumference of the torque rod 28, so that the tubular bushings 29, 30 that have been pressed onto both ends of the torque rod 28 are joined with it in a non-rotating fashion.

The tubular bushings 29, 30 are supported at each of their round outer end regions in bearing bushes 31, 32, which are provided on the underside of the seat 2. While the right tubular housing 29 in FIG. 4 is held in a non-rotating fashion at its opposite, inner end region in a central bearing bush 33 with an inner cross-section that has been matched in shape to the outer circumference of the tubular bushing 29, the left tubular bushing 30 in FIG. 4 is joined with the support lever 10 in a non-rotating fashion.

The weight $F_G$ of the person who is on the seat 2 is thus transmitted via the bearing bush 33, which is joined with the tubular bushing 29 in a non-rotating manner, to the torque rod 28, and continues from here via the tubular bushing 30 to the support lever 10 that is joined with it in a non-rotating fashion. This support lever 10 is joined in a non-rotating fashion with the tubular bushing 30, and is supported on the upper face of the cylinder 27 of the gas pressure spring 26, which protrudes, inside the guide bushing 25, above the guide bushing 24.

The office swivel chair shown here is distinguished by its simple construction and compact design. It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

I claim:

1. A chair, particularly, an office chair, comprising a seat support (6) fastened to a lower chair part (7) and joined in a swiveling fashion with a seat (2) that is movably coupled with a backrest (3) by means of a synchronizing sliding guide (5), wherein the seat (2) is supported by a readjusting apparatus (8) that acts against swiveling movement, the seat support (6) being guided at the lower chair part (7) in an approximately vertical direction, the seat (2) being supported at the lower chair part (7) by the readjusting apparatus (8), whereby a movement transmission path is provided between the backrest (3) and the lower part (7) of the chair, and further comprising a blocking apparatus (14) to compensate for movement transmitted to the readjusting apparatus (8) during a backward swinging movement of the backrest (3).

2. The chair in accordance with claim 1, wherein the blocking apparatus (14) operates against transmission of movement between the seat support (6) and the lower chair part (7), and is activated during a backward swinging movement of the backrest (3).

3. The chair in accordance with claim 1, wherein the blocking apparatus (14) is coupled with the synchronizing sliding guide (5).

4. The chair in accordance with claim 1, wherein the readjusting apparatus (8) comprises a force adjusting torsion bar (9) located in a swiveling axis between the seat (2) and the seat support (6), the torsion bar (9) being held at the seat (2) in a fixed manner so it cannot rotate and joined to one end of a support lever (10), in a fixed manner so it cannot rotate, the support lever (10) being supported near its other free end, on the lower chair part (7).

5. The chair in accordance with claim 1, wherein the blocking apparatus (14) is configured as a braking device that is rigidly joined to the seat support (6) and that, in a blocking position, engages with the lower chair part (7).

6. The chair in accordance with claim 5, wherein the braking device frictionally engages the lower chair part (7).

7. The chair in accordance with claim 1 wherein the blocking apparatus (14) comprises a clamping collar (15).

8. The chair in accordance with claim 7, wherein the clamping collar (15), encompasses a section of the lower chair part (7) that protrudes in an approximately vertical direction and, in its blocking position, lies at least partially in frictional engagement against the section of the lower chair part (7).

9. The chair in accordance with claim 7, wherein the clamping collar (15) comprises two free collar arms (16, 17), at least one of the two free collar arms (16, 17) being provided with an outwardly directed ramp bevel (18), the ramp bevel (18) cooperating with a corresponding matching bevel (19) supported in an essentially immovable manner axially and movably coupled with the backrest (3).

10. The chair in accordance with claim 9, wherein the ramp bevel (18) has a helical shape.

11. The chair in accordance with claim 9, wherein each of the two free collar arms (16, 17) of the clamping collar (15) has a helical ramp bevel (18) having a helical shape, each of the two ramp bevels (18) has an associated matching bevel (19) that is supported in an essentially immovable fashion axially, and the ramp bevels (18) have beveled surfaces on opposite sides of the clamping collar whose helical shapes are oriented in opposite directions of rotation.

12. The chair in accordance with claim 11, wherein the backrest (3) is joined with a backrest support (11) that is guided in an adjustable fashion in the synchronizing sliding guide (5), the backrest support (11) being joined to at least one clamping lever (22) that is supported in a pivoting fashion on a common axis of rotation (21) with the matching bevels (19), each clamping lever (22) being associated with a matching bevel (19) that is joined to it in a non-rotating fashion.

13. The chair in accordance with claim 1, wherein the lower chair part (7) is adjustable in height and comprises for that purpose two vertical guides.

14. The chair in accordance with claim 13, wherein the vertical guides comprise two enclosing guide bushings (24, 25), of which a first guide bushing (24) is associated with a height adjustment element (26), and a second guide bushing (25) is associated with the seat support (6).

15. The chair in accordance with claim 14, wherein the height adjustment element (26) comprises a gas pressure spring.

16. The chair in accordance with claim 14, wherein the blocking apparatus (14) comprises a clamping collar (15) which in its blocking position, engages with an upper section of the height adjustment element (26) that projects above the first guide bushing (24).

* * * * *